US005130916A

United States Patent [19]

Toth

[11] Patent Number: 5,130,916

[45] Date of Patent: Jul. 14, 1992

[54] RETRACTABLE LOW VOLTAGE LIGHTING FIXTURE

[75] Inventor: Louis Toth, Fairfield, Conn.

[73] Assignee: Aqua-Lawn, Inc., Fairfield, Conn.

[21] Appl. No.: 796,763

[22] Filed: Nov. 25, 1991

Related U.S. Application Data

[63] Continuation-in-part of Ser. No. 668,976, Mar. 13, 1991, Pat. No. 5,068,773.

[51] Int. Cl.[5] ..... F21V 21/22

[52] U.S. Cl. ..... 362/386; 362/20; 362/183; 362/286; 362/364; 362/802

[58] Field of Search ..... 362/20, 65, 63, 153, 362/153.1, 286, 276, 183, 364, 372, 386, 394, 802, 291

[56] References Cited

U.S. PATENT DOCUMENTS

| | | | |
|---|---|---|---|
| 1,212,642 | 1/1917 | Hoffman | 362/385 X |
| 2,401,390 | 6/1946 | Unger | 362/386 X |
| 2,738,492 | 3/1956 | Arneson et al. | 362/285 X |
| 3,402,288 | 9/1968 | Diebel et al. | 362/385 |
| 4,180,850 | 12/1979 | Bivens | 362/285 |
| 4,272,802 | 6/1981 | Steadman | 362/385 |
| 4,300,186 | 11/1981 | Hurd | 362/66 |
| 4,802,069 | 1/1989 | Chandler | 362/83 |
| 4,974,134 | 11/1990 | Bourne | 362/386 X |
| 4,984,139 | 1/1991 | Goggia | 362/386 X |
| 5,068,773 | 11/1991 | Toth | 362/386 |

*Primary Examiner*—Stephen F. Husar

*Attorney, Agent, or Firm*—Ware, Fressola, Van Der Sluys & Adolphson

[57] ABSTRACT

A retractable low voltage lighting fixture can be buried in the ground leaving only the top surface exposed and flush with the ground surface. When activated, an interior lamp housing raises out of the ground via a mechanical drive and a lamp contained therein lights up. The lighting fixture provides illumination for walkways, driveways and other areas requiring outdoor lighting. After a specified period of time, the light goes off and the interior housing is driven back down into the ground flush with the ground surface, completely hidden and out of the way of possible damage by vandalism or accidental breakage. The lighting fixture is comprised of two major component parts—an interior lamp housing and an elongated exterior housing. The interior lamp housing houses the following components: switches, gearbox, motor, electrical components, batteries and light bulb. The exterior housing is buried in the ground and slideably receives the interior lamp housing. The exterior housing provides the appropriate electrical connections and removably receives a gear rack to which the interior lamp housing is drivingly engaged.

39 Claims, 15 Drawing Sheets

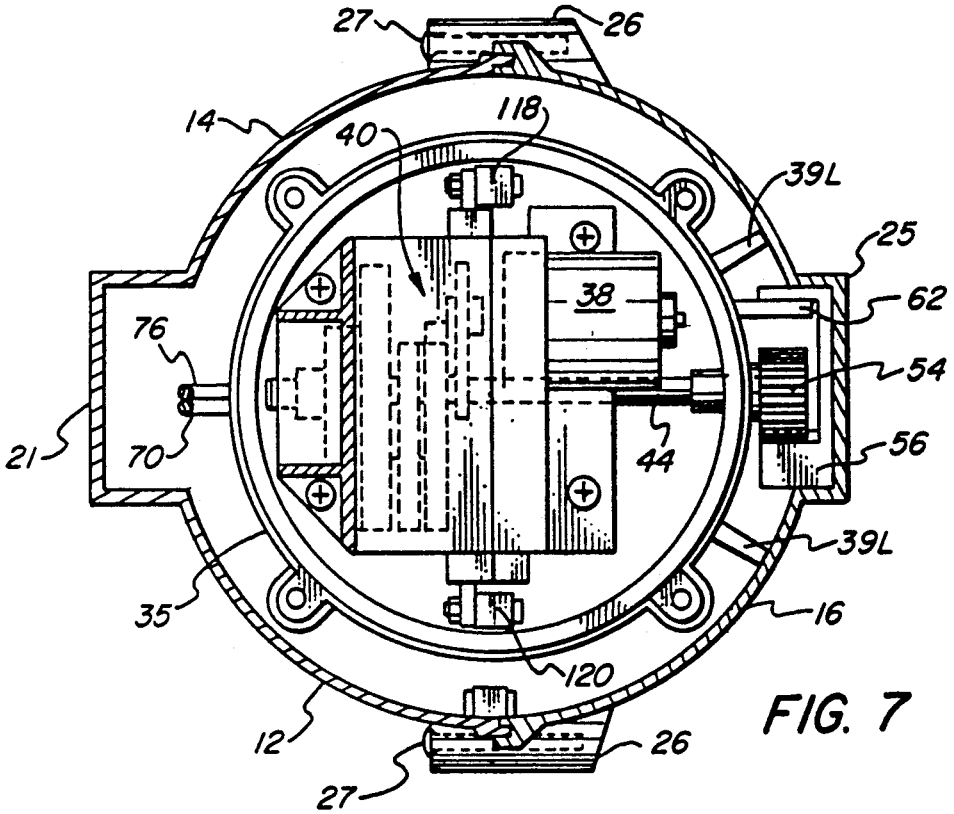
FIG. 7
FIG. 8
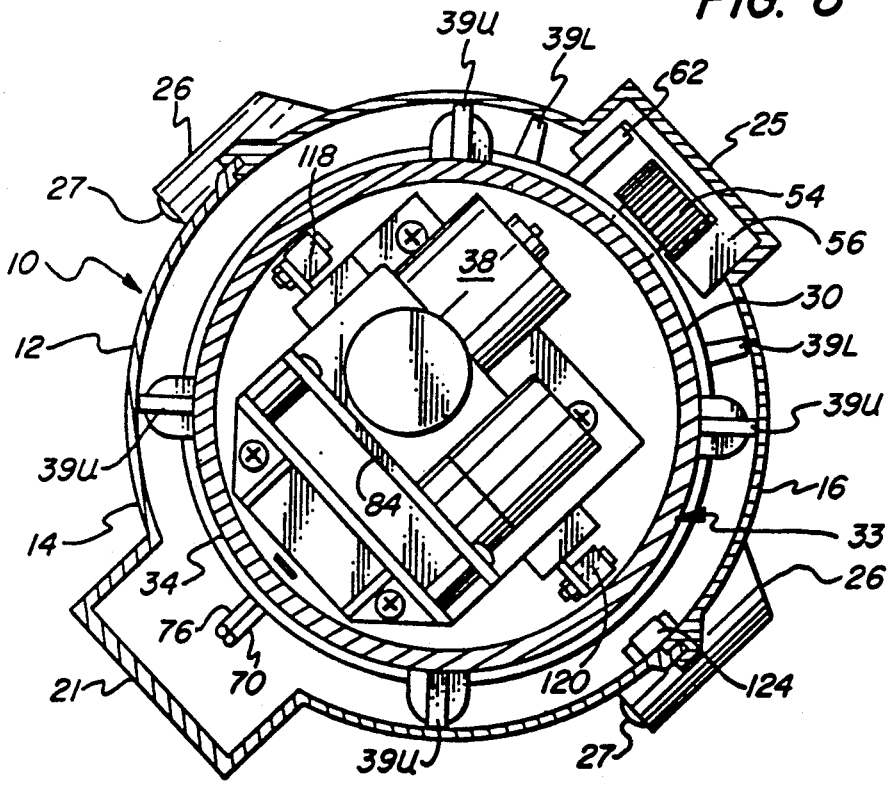

RETRACTABLE LOW VOLTAGE LIGHTING FIXTURE

This is a continuation-in-part of copending application Ser. No. 07/668,976 filed Mar. 13, 1991, now U.S. Pat. No. 5,068,773.

BACKGROUND OF THE INVENTION

The present invention relates generally to low voltage landscape lighting fixtures, and more particularly to such a low voltage lighting fixture which can be recessed in the ground and pop up therefrom when illumination is desired.

In conventional low voltage landscape lighting systems, low voltage outdoor light fixtures are mounted so as to extend upwardly from the ground with low voltage underground cable running therebetween. Such fixtures are visually obtrusive as well as being hazardous since persons can trip over the fixtures. Additionally, they create a maintenance problem such as impeding lawn mowing.

The present invention is designed to overcome the above-noted limitations that are attendant upon the use of conventional low voltage lighting systems. Toward this end, it contemplates the provision of a novel low voltage light fixture capable of being inserted in the ground in a flush manner yet having an interior lamp housing slideably seated therein which protracts from the ground when the lighting fixture is activated.

It is an object of the invention to provide a low voltage lighting fixture in which the electrical components are in a watertight compartment so the fixture can be used in damp locations.

It is also an object to provide such a fixture to eliminate the hazard and inconvenience presented by conventional aboveground low voltage lighting fixtures.

Still another object is to provide such a fixture which has a safety interlock feature to deactivate the fixture in the event the interior lamp housing is obstructed during extension or retraction thereof.

A further object is to provide such a fixture which may be readily and economically fabricated and will enjoy a long life in operation.

SUMMARY OF THE INVENTION

It has now been found that the foregoing and related objects can be readily attained in a low voltage lighting fixture for in-ground installation. The lighting fixture includes an elongated exterior housing and a slideable watertight interior housing. The elongated exterior housing is adapted to be at least partially buried in the ground and has an opening at one end thereof. The interior housing is slideably mounted for reciprocation from a retracted position within the elongated housing to a protracted position through the opening and at least partially extended from the elongated housing. The interior housing has an upper lamp portion and a lower motor portion. The lower motor portion of the interior housing has a motorized drive for operationally engaging the exterior housing for moving the interior housing between its retracted and protracted positions. A lamp is carried in the upper lamp portion of the interior housing.

In order to power the lighting fixture, a primary electrical power source extends through the exterior housing into the interior housing and is operatively connected to the lamp and the motorized drive. Activation of the primary electrical power source illuminates the lamp and causes the motorized drive to move the interior housing from its retracted position to its protracted position while deactivation of the primary electrical power source deenergizes the lamp and causes the motorized drive to move the interior housing from its protracted position to its retracted position.

Conveniently, the motorized drive is provided with a safety interlock device for deactivating the motorized drive in the event the interior housing is obstructed from moving between its retracted and protracted positions. The safety interlock means includes a slip clutch device permitting the motorized drive to continue to operate in the event movement of the interior housing is obstructed. The slip clutch also facilitates the removal of the interior housing from the exterior housing. The safety interlock device also includes a circuit breaker to deenergize the motorized drive in the event movement of the interior housing is obstructed. The circuit breaker operates in response to an overload on the motorized drive.

Desirably, the motorized drive includes an auxiliary electrical power source to energize the motorized drive to move the interior housing from its protracted position to its retracted position when the primary electrical power source is deactivated. The auxiliary electrical power source includes a rechargeable battery pack connected to the primary power source and rechargeable when the interior housing is in its protracted position.

In the first embodiment, motorized drive includes limit switches to deactivate the motorized drive in the retracted and protracted positions of the interior housing. The limit switches are magnetically actuated proximity switches mounted on the interior housing and actuated by magnets on the exterior housing.

Ideally, the motorized drive includes a high speed drive motor and a gear reduction system to yield a high torque output from the high-speed motor thereby providing a substantial driving force to the interior housing. The gear reduction system has a final drive shaft extending outside the interior housing and drivingly engaging the exterior housing. The final drive shaft has a pinion gear on a portion thereof exterior of the interior housing drivingly engaging a gear rack on the exterior housing. The exterior housing has a cover mounted on an end thereof for holding the gear rack in place within the exterior housing.

Additionally, the upper lamp portion of the interior housing is removable to provide access for servicing the lamp mounted therein. The interior housing has a lens mounted within the upper lamp portion of the interior housing. The low voltage lighting fixture in accordance with the lens can be a diffuser lens and a light baffle to appropriately direct light from the lamp.

In the second embodiment, a removable battery pack with the lamp mounted thereto is used to provide power to the motorized drive to move the interior housing from its protracted position to its retracted position. A portion of the interior housing is easily disassembled to provide access to the battery pack and to permit replacement of the lens components of the lighting fixture. The power to the motorized drive can be disconnected by a control circuit by utilizing magnetic actuated switches and/or resettable circuit breakers/-fuses.

The invention will be more fully understood when reference is made to the following detailed description taken in conjunction with the accompanying drawings.

BRIEF DESCRIPTION OF THE DRAWINGS

FIG. 7 is a cross-sectional view taken along the 7—7 line of FIG. 5 with a portion of the interior housing removed to illustrate the drive motor section;

FIG. 8 is a cross-sectional view taken along the 8—8 line of FIG. 6;

DETAILED DESCRIPTION OF THE PREFERRED EMBODIMENTS

Figure 1:
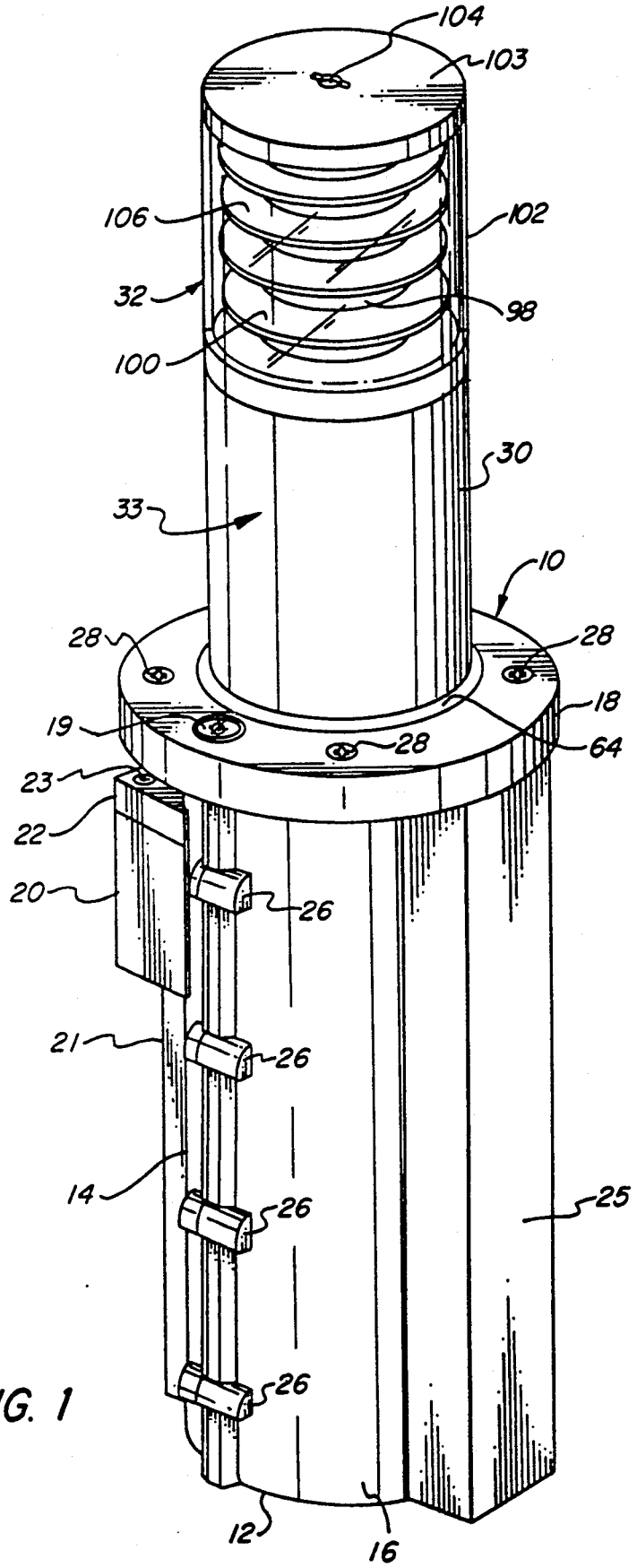
FIG. 1 is a perspective view of a low voltage lighting fixture embodying the present invention with its interior housing in its protracted position.
Figure 2:
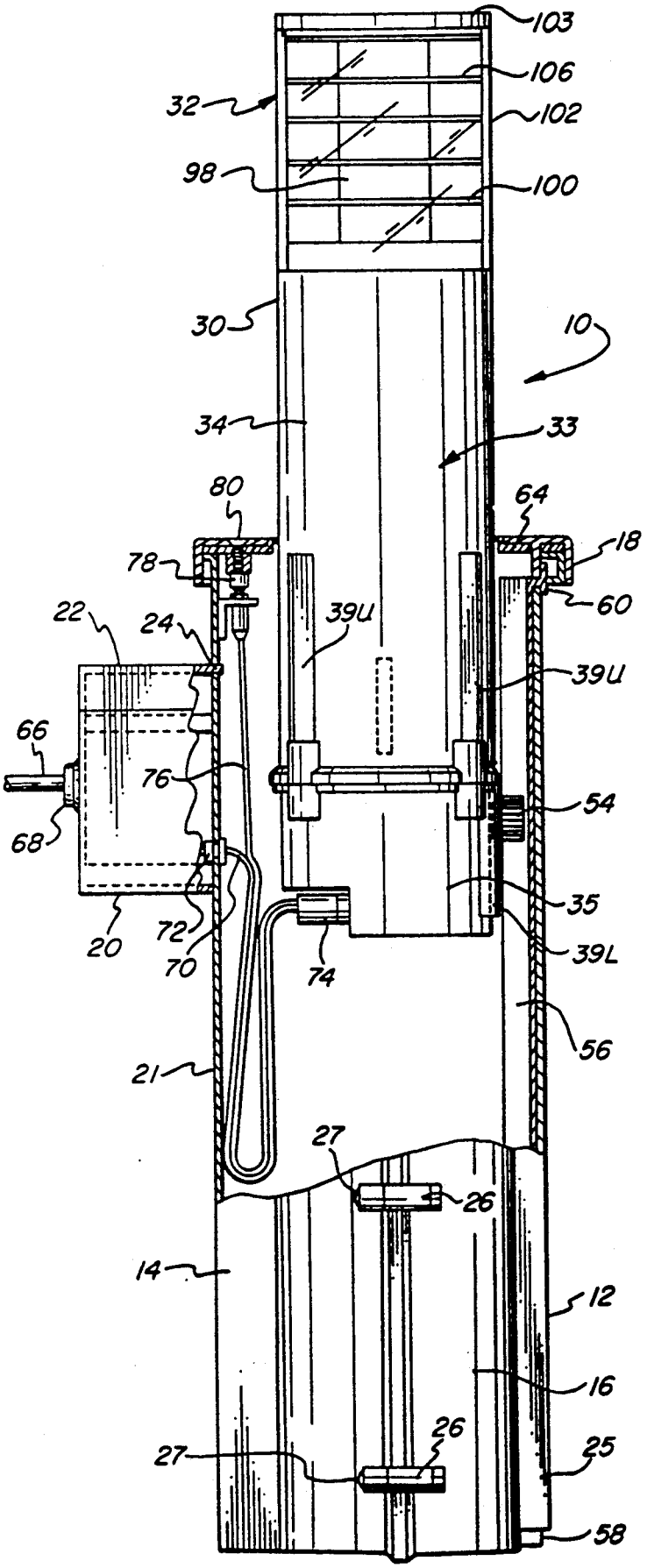
FIG. 2 is a side elevational view of the low voltage lighting fixture with its interior housing in its protracted position and its exterior housing partially broken away to show internal structure.
Figure 3:
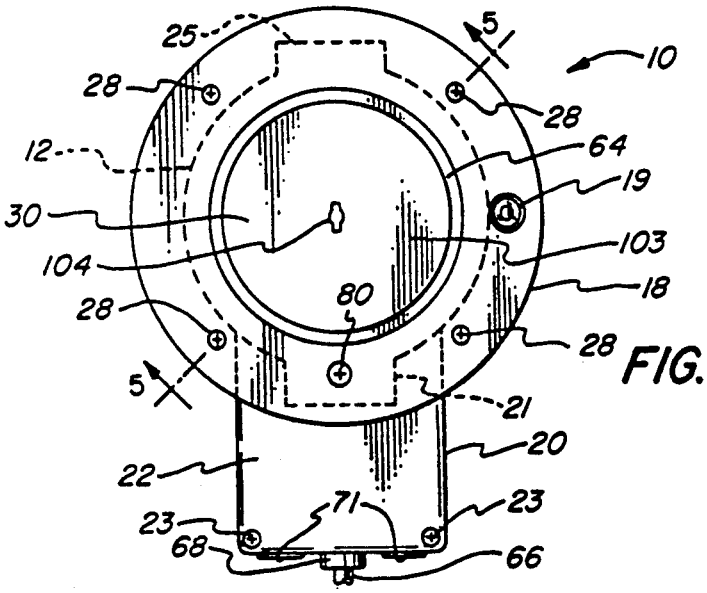
FIG. 3 is a top plan view of the low voltage lighting fixture with its interior housing in its retracted position.
Figure 4:
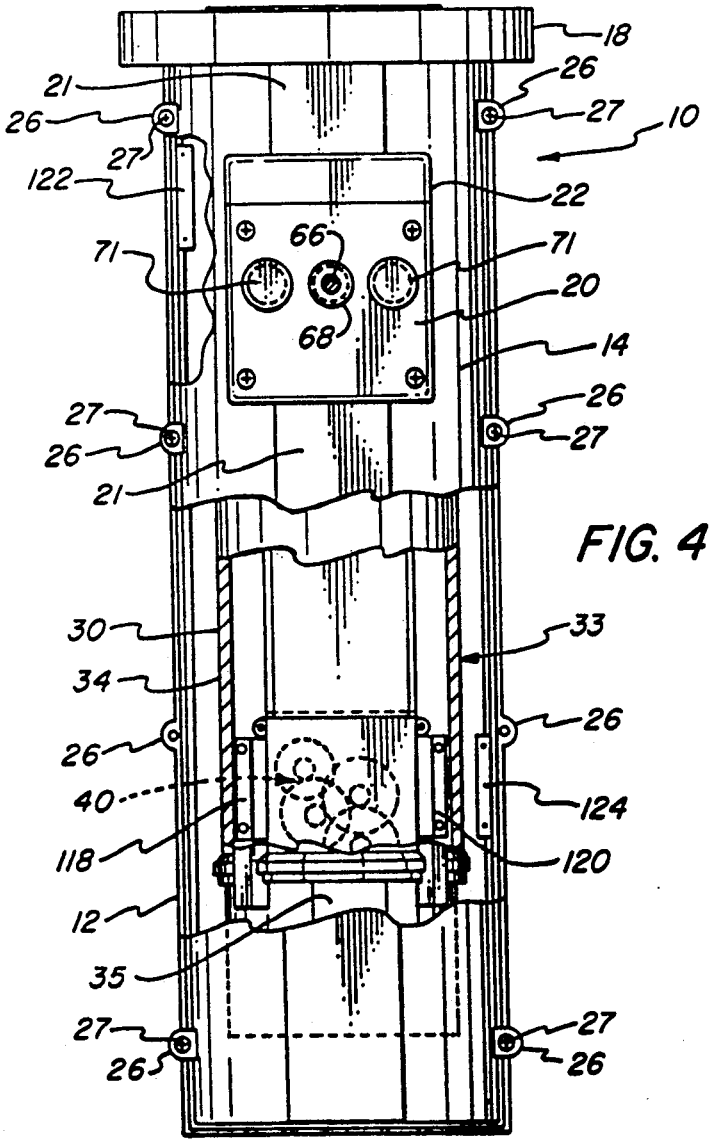
FIG. 4 is a side elevational view of the low voltage light fixture with its interior housing in its retracted position and its exterior housing partially broken away to show internal structure.
Figure 5:
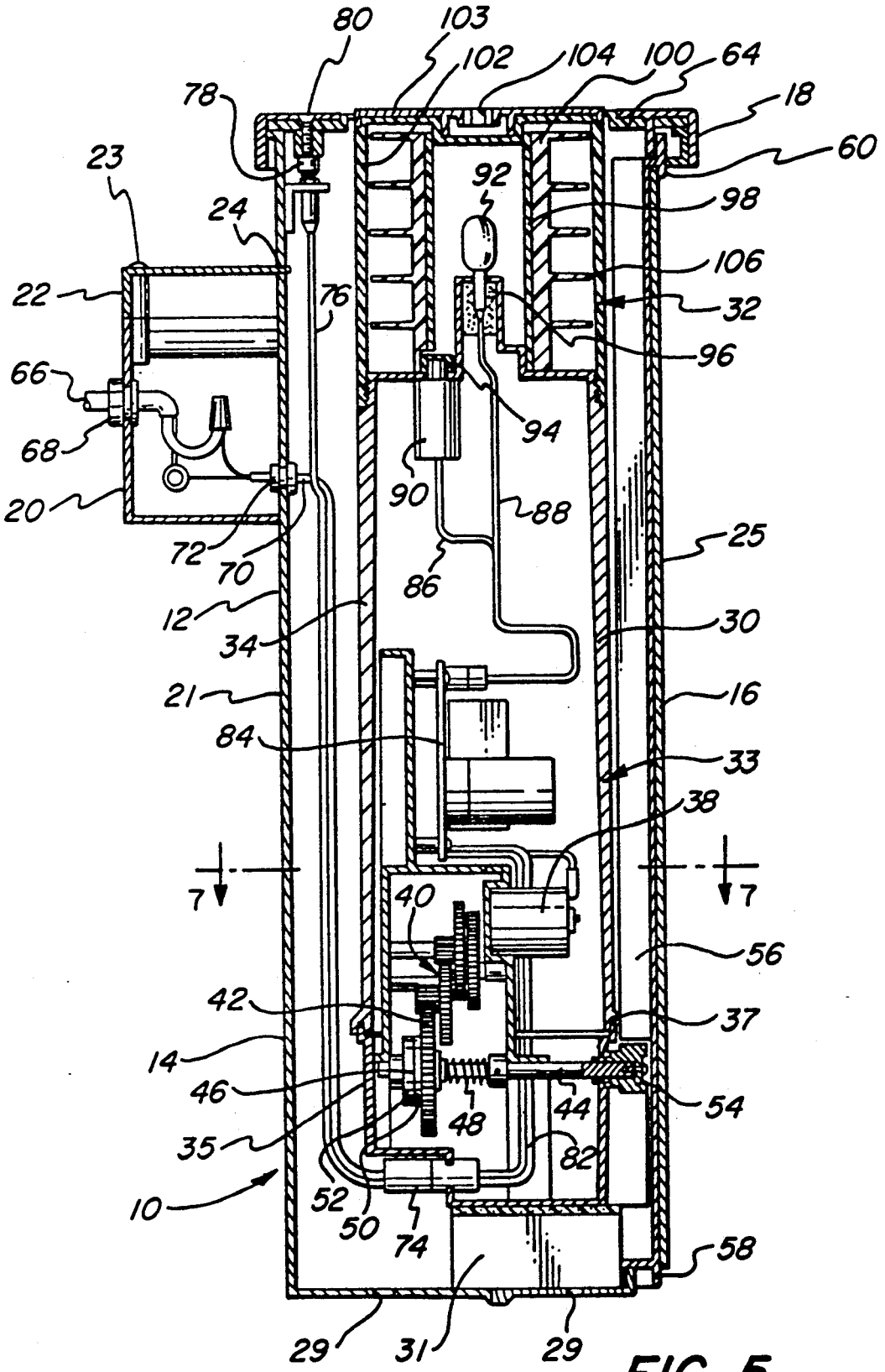
FIG. 5 is a cross-sectional view taken along the 5—5 line of FIG. 3.
Figure 6:
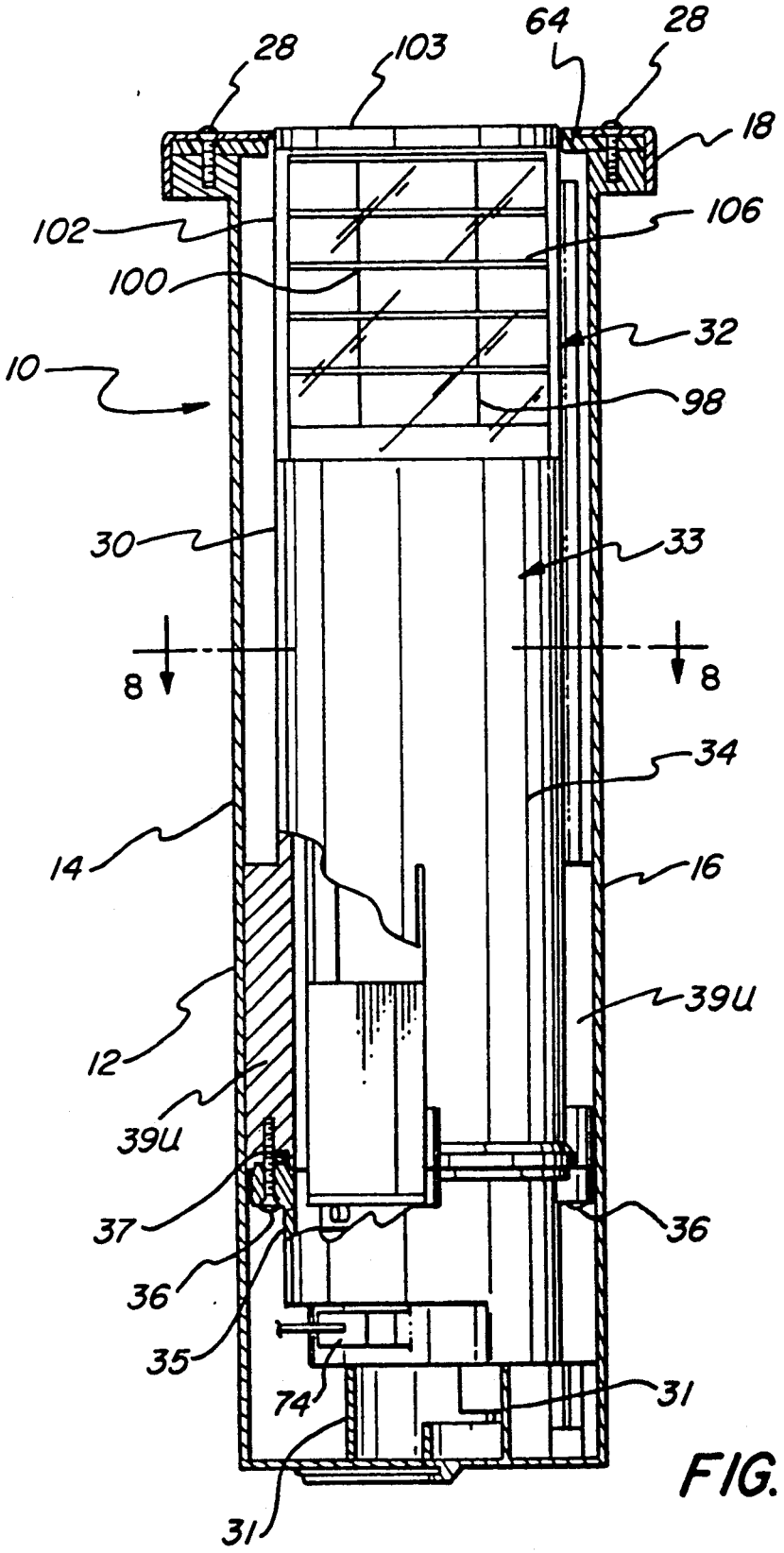
FIG. 6 is a side elevational view of the low voltage lighting fixture with portions broken away to show internal structure.
Figure 11:
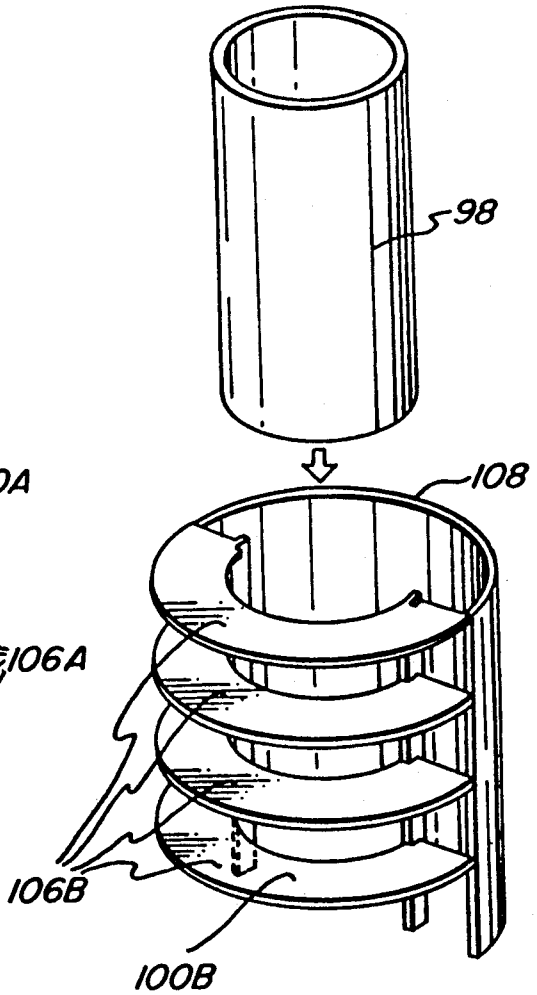
FIGS. 9 through 11 are perspective views of three different embodiments of the light baffle system of the low voltage light fixture of the present invention.
Figure 10:
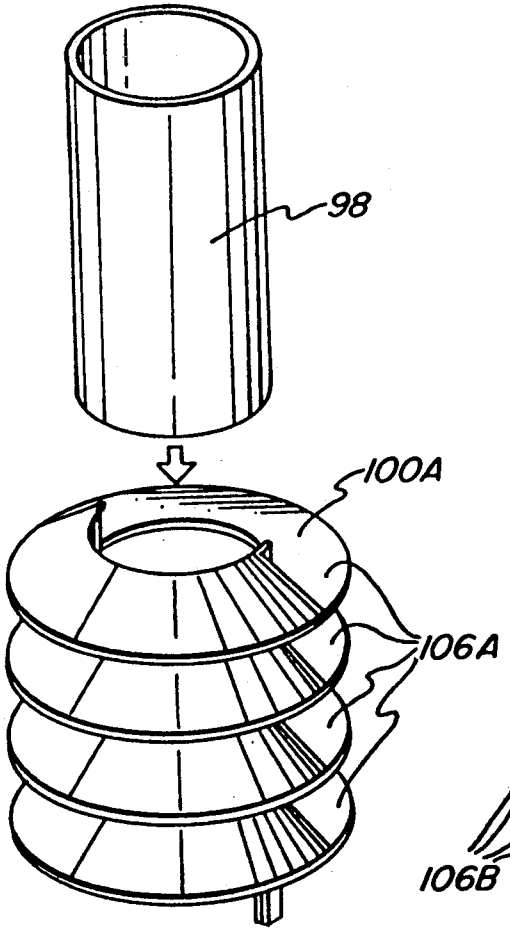
Figure 9:
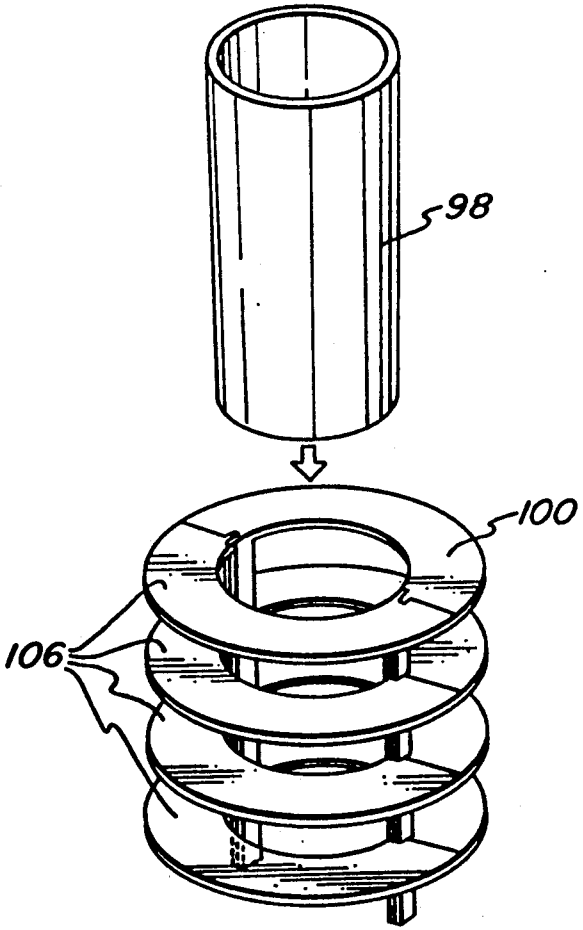
Figure 12:
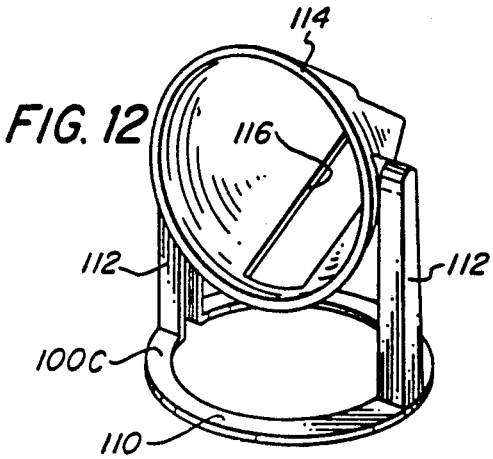
FIG. 12 is a perspective view of a spotlight baffle for the low voltage lighting fixture.
Figure 14:
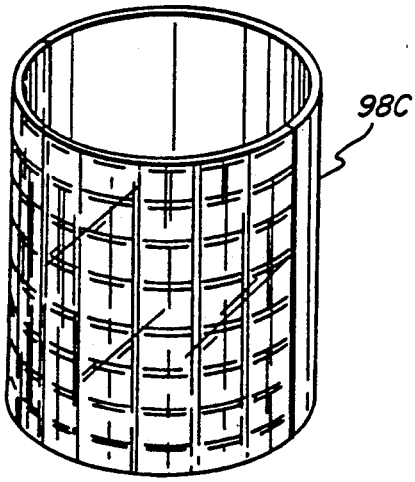
FIG. 14 is a perspective view of a diffuser used in combination with the spotlight baffle of FIG. 12.

Referring first to FIGS. 1 and 2 therein is illustrated a low voltage lighting fixture generally designated by the numeral 10 and made according to the present invention. The low voltage lighting fixture 10 has a hollow elongated cylindrically-shaped exterior housing 12 comprised of two opposed mating housing members 14 and 16 and an annular shaped cover member 18. The annular shaped cover member 18 has a leveling device 19 in the form of a bubble level for facilitating installation of the lighting fixture 10 in the ground. The first housing member 14 is provided with an electrical junction box 20 at the upper end thereof attached to a rectangular extension 21 running vertically on the elongated exterior housing 12. Mounted on top of the electrical junction box 20 is a junction box cover 22 secured thereto through cooperation of self tapping screws 23 extending through the junction box cover 22 into the electrical junction box 20 and a tab 24 extending through exterior of the rectangular extension 21 of elongated exterior housing 12. The second housing member 16 has a rectangular extension 25 which runs its entire length. The mating sides of the opposed housing members 14 and 16 form eight screw bosses 26 (four shown in FIG. 1) into which are secured appropriate self tapping screw fasteners 27 (see FIG. 2) to hold the opposed housing members 14 and 16 in assembly. In turn, to hold the annular shaped cover member 18 to the opposed housing members 14 and 16, four self tapping screw fasteners 28 (only three shown in FIG. 1) extend through the annular shaped cover member 18 and into the opposed housing members 14 and 16 (see FIG. 6). As illustrated in FIG. 5, the bottom of the exterior housing 12 has drain holes 29 to permit the egress of water.

The low voltage lighting fixture 10 also includes a cylindrical interior lamp housing 30 retractable into the elongated exterior housing 12 into a position abutting a pair of bumper stop ribs 31 (FIGS. 5 and 6) extending upwardly from the bottom of the interior housing 30. The interior housing 30 is watertight to protect the electrical and mechanical components contained therein as will be described further hereinafter. In FIGS. 1 and 2, the interior housing 30 is shown in its protracted or actuated position and includes an upper lamp portion generally indicated by the numeral 32 and a lower motor portion generally indicated by the numeral 33. The lower motor portion 33 has a main body member 34 secured to a lower body member 35 by screw fasteners 36. To maintain the waterproof nature of the interior housing 30, an O-ring 37 is sandwiched between the main body member 34 and lower body member 35.

As seen in FIGS. 2 and 8, the exterior of the lower motor portion 33 has four upper integrally molded spaced apart guide ribs 39U in sliding contact with the cylindrical interior of the elongated exterior housing 12 to stabilize the interior housing 30 during retraction and protraction thereof. Two additional lower guide ribs 39L (FIG. 8) are provided for a similar reason. To accomplish the movement of the interior housing 30, a motorized drive mechanism is provided in the lower motor portion 33 of the interior housing 30 as best seen in FIG. 5.

The motorized drive mechanism has a low voltage high speed direct current motor 38 rated at approximately six thousand rpm. To achieve the high torque needed to move the interior housing 30 between its retracted and protracted positions, a speed reduction mechanism in the form of a gear train generally indicated by the numeral 40 is provided in a well-known manner. A final gear 42 in the gear train 40 is rotatably mounted on a drive shaft 44 journalled for rotation in the lower motor portion 33 of the interior housing 30. One side of the final gear 42 includes a slip clutch 46 while the other side of the final gear 42 has a biasing compression coil spring 48 surrounding the drive shaft 44. The slip clutch 46 has two clutch halves 50 and 52. The first clutch half 50 is integral and rotatable with the final gear 42 while the second clutch half 52 is mounted on the drive shaft 44 for rotation therewith. The biasing compression coil spring 48 presses against the side of the final gear 42 thereby biasing the clutch halves 50 and 52 into intimate contact. The clutch halves 50 and 52 utilize ramps and detents (not shown) to permit driving engagement between the gear train 40 and the drive shaft 44 in a well-known manner. The detents and ramps on the clutch halves 50 and 52 are designed to allow more force to be applied to the drive shaft 44 in the protraction drive mode as compared to the retraction drive mode.

The drive shaft 44 extends through the wall of the interior housing 30. Fixedly mounted on the protruding end of the drive shaft 44 opposite the slip clutch 46 is a pinion gear 54 sized for driving engagement with a gear rack 56 on the elongated exterior housing within the rectangular extension 25. A lower tab portion 58 of the rack 56 extends through the bottom of the elongated exterior housing 12 while an upper end portion 60 is captured between the main body member 34 and the annular shaped cover member 18 whereby the rack 56 is securely but removably held in the elongated exterior housing 12. Also captured between the elongated exterior housing 12 and the annular shaped cover member 18 is a resilient wiper gasket 64 which surrounds the interior housing 30 and seals the area between the annular shaped cover member 18 and the interior housing 30. Referring to FIGS. 7 and 8, a guide flange 62 from the interior housing 30 extends into the interior of the U-shaped rack 56 thereby preventing counterclockwise rotation of the interior housing 30 relative to the elongated exterior housing 12.

Turning again to FIG. 5, a twelve-volt alternating current (12 VAC) electrical line 66 extends through a rubber grommet 68 mounted on the electrical junction box 20 where it is connected to a flexible electrical cable 70 residing within the rectangular extension 25 of the elongated exterior housing 12. The electrical junction box 20 includes two punch-out members 71 through which additional electrical lines can pass if the low voltage lighting fixture 10 is going to be connected to a sequence of other low voltage retractable lighting fixtures. The flexible electrical cable 70 runs through a rubber grommet 72 in the rectangular extension 25 to an electrical connector 74 extending through and sealed to the interior housing 30. Also, running with the flexible electrical cable 70 in the rectangular extension 25 is an auxiliary shutoff electrical line 76 which connects switch 78 to the electrical connector 74. Switch 78 is a momentary normally open switch which is engaged by a screw 80 in the annular shaped cover member 18 to hold the switch 78 in its closed, actuated position. The screw 80 can be loosened to deactivate the switch 78.

Electrical lines 82 run from the electrical connector 74 to a printed circuit board 84, the configuration and operation of which will be explained further hereinafter. Electrical lines 86 and 88 extend from the printed circuit board 84 to a circuit breaker 90 and a lamp 92, respectively. The circuit breaker 90 is mounted in the main body member 34 of the interior housing 30 and is covered by a waterproof gasket 94. The lamp 92 is also mounted on the main body member 34 in an appropriately styled socket 96.

Surrounding the lamp 92 is the upper lamp portion 32 which includes an inner diffuser lens 98, a light baffle 100 and a transparent outer lens 102. The outer lens 102 threadingly engages the main body member 34 at the outer periphery thereof so as to be releasably secured thereto. The upper end of the outer lens 102 is provided with an interior housing cover 103 having a keyhole shaped aperture 104 dimensional sized for insertion of a key (not shown) to facilitate manual removal of the interior housing 30 from the elongated exterior housing 12 when the interior housing 30 is in its protracted position.

Figure 13:
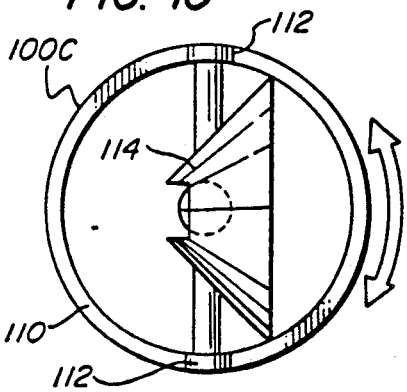
FIG. 13 is a top plan view of the spotlight baffle of FIG. 12.
Figure 15:
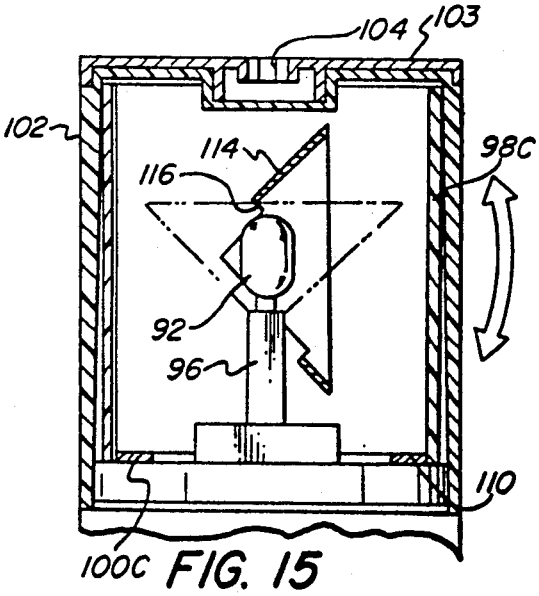
FIGS. 15 and 16 are partial side elevational views, from different angles, of the interior housing of the low voltage lighting fixture with the spotlight baffle installed therein, the spotlight baffle in FIG. 15 is shown in alternative positions (solid and phantom line)
Figure 16:
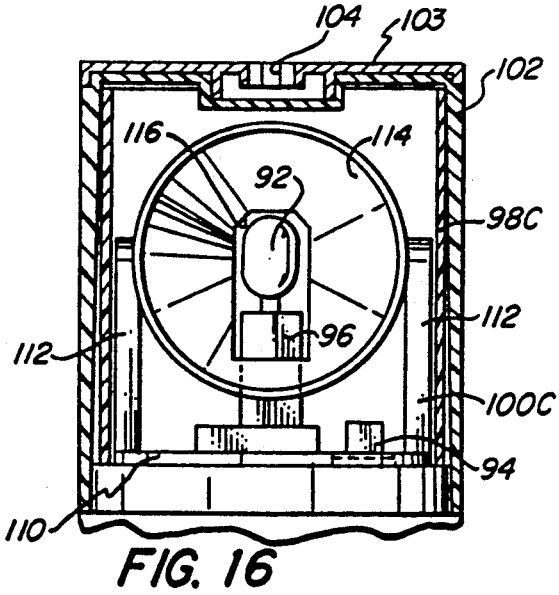

The upper lamp portion 32 can take the various forms or styles as shown in FIGS. 9 through 16. The FIG. 9 style is the one shown installed in FIGS. 1 through 8. Fins 106 are designed to stop light from the lamp 92 from radiating into the eyes of a passerby when the low voltage lighting fixture is viewed at a normal viewing angle when used on a walkway. In the FIG. 10 style, fins 106A on the light baffle 100A are downwardly inclined to focus the light from the lamp 92 downwardly into a small area. In the baffle 100B of FIG. 11, a reflector or shield 108 is used with fins 106B to intensify the light on one side of the low voltage lighting fixture 10 to create a 180° light source rather than a 360° light source. Finally, a spotlight effect can be created by using the baffle style of FIGS. 12 through 16. A spotlight baffle 100C includes a stand 110 with two upstanding legs 112. Pivotally mounted between the upstanding legs 112 is a reflective cone 114 having an elongated slot 116 therein to provide clearance for the lamp 92. A transparent patterned diffuser 98C (FIG. 14) can be used with the spotlight baffle 100C to provide a uniquely dispersed light pattern. Both the spotlight baffle 100C and its reflective cone 114 can be rotated as illustrated in FIGS. 13 and 15 so as to direct the light in a desired direction.

Referring again to FIGS. 4, 7 and 8, mounted inside the interior housing 30 at a lower end of the main body member 34 are opposed single pull, double throw magnetic proximity reed switches 118 and 120. These switches 118 and 120 are positioned to be actuated by magnetic actuators 122 and 124, respectively, located on the inside of the elongated exterior housing 12 to control the movement of the interior housing 30 as will be explained forthwith.

Figure 17:
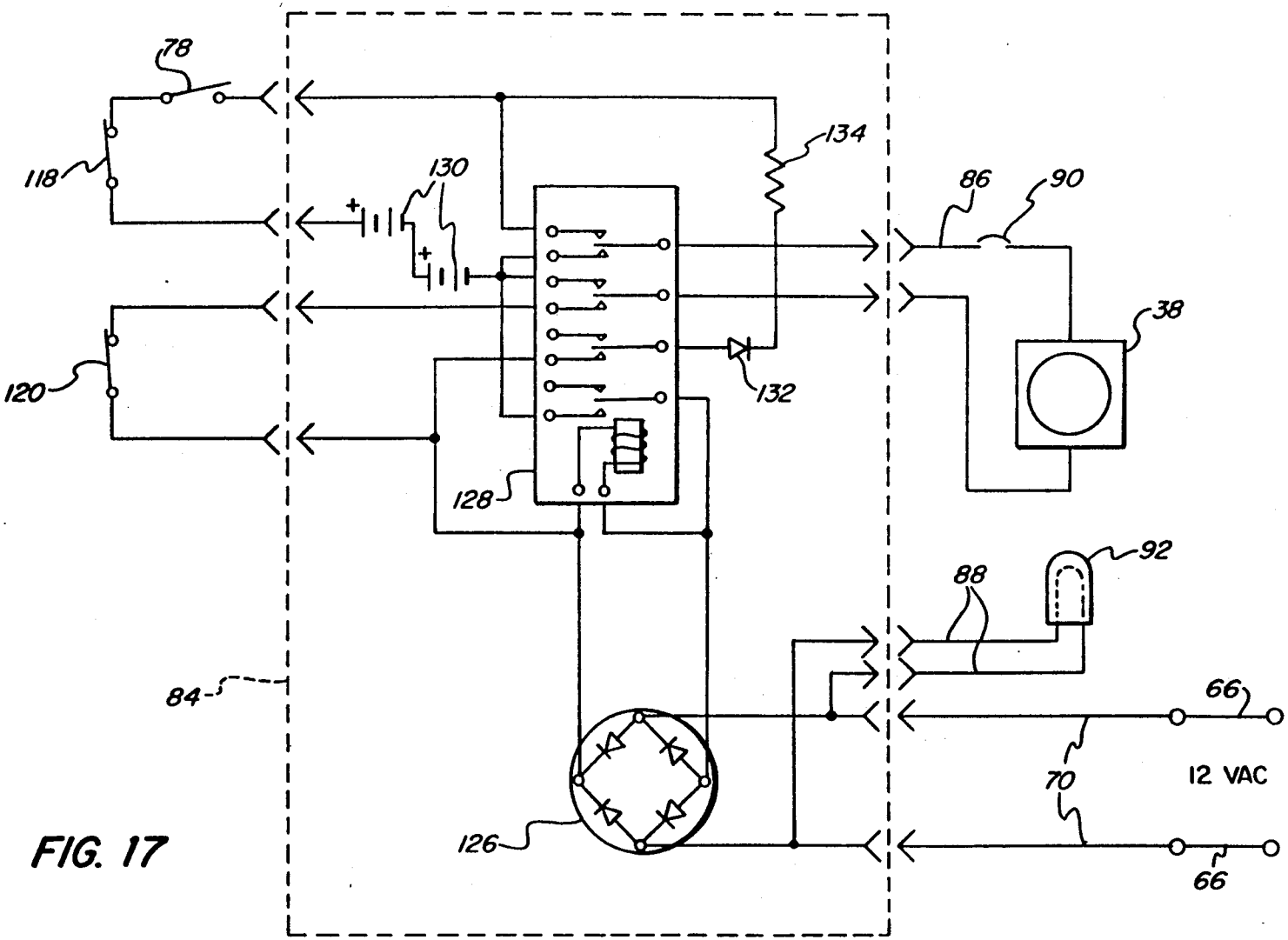
FIG. 17 is a circuit diagram of the control circuit for the low voltage lighting fixture of the present invention.

Turning now to FIG. 17, therein illustrated is a circuit used to control the up and down movement of the interior housing 30. The circuit includes a bridge rectifier 126 (100 V, 1.4 A), a four pole-double throw relay 128, a 3.6 volt rechargeable battery pack 130, a diode 132 and a resistor 134, all on the printed circuit board 84.

The circuit operates in the following manner. In the normal unpowered state of the lighting fixture 10, the interior housing 30 is fully retracted into the elongated exterior housing 12 as shown in FIG. 5. To activate the low voltage lighting fixture 10, twelve-volt alternating current electrical power can be applied to the input electrical cable 66 through use of a timing switch or low light sensor (not shown) whereby the lamp 92 is powered. The bridge rectifier 126 supplies direct current voltage to the coil of the relay 128. The relay 128 is then activated switching power to the motor 38 driving the interior housing 30 in an upward direction through mechanical cooperation of the gear train 40, slip clutch 46, drive shaft 44, pinion gear 54 and rack 56. The relay 128 also supplies a charging current to the battery pack 130.

The interior housing 30 stops its movement in the upward direction as power is cut off to the motor 38 when the upper proximity switch 118 is opened by the upper magnetic actuator 122 in the elongated exterior housing 12. The rechargeable battery pack 130 is charged by the current through diode 132 and limiting resistor 134 as long as both the battery switch 78 is closed and the electrical power is supplied through the electrical line 66.

If an outside influence, such as a vandal or other obstruction, were to push down on the interior housing 30 when it is in its protracted position, the slip clutch 46 will slip allowing the drive shaft 44 and pinion gear 54 to rotate independently of the gear train 40 thereby permitting retraction of the interior housing 30 without damage to the low voltage lighting fixture 10. Once the outside influence is removed, the motor 38 will return the interior housing 30 to its protracted position.

To deactivate the low voltage lighting fixture 10, the twelve-volt alternative current electrical power is removed from the input electrical cable 66 through use of the timing switch or low light sensor (not shown) whereby the relay 128 and lamp 92 are deactivated. In turn, the relay 128 switches power to the motor 38 via the battery pack 130. The motor 38 drives the interior housing 30 in the downward direction through cooperation of the gear train 40, slip clutch 46, drive shaft 44, pinion gear 54 and rack 56 until the lower proximity switch 120 opens when actuated by the magnetic actuator 124 as the interior housing 30 returns to its retracted position.

If an outside influence interferes with the movement of the interior housing 30 as it moves between its retracted and protracted positions for a sufficient period of time, the circuit breaker 90 will disengage power from the motor 38. To reset the circuit breaker 90, the upper lamp portion 32 is unscrewed from the lower motor portion 33 providing access to the circuit breaker 90 for resetting the same.

In the event the low voltage lighting fixture 10 needs servicing, this can be easily accomplished by first removing the power from the electrical line 66. By loosening the screw 80, the battery switch 78 can be used to disconnect the battery pack 130 to stop the motor 38 from being driven in the downward direction. By placing a key (not shown) in the keyhole shaped aperture 104 of the interior housing cover 103, the interior housing 30 can be pulled out of the elongated exterior housing 12 as the slip clutch 46 allows the pinion gear 54 and drive shaft 44 to rotate independently of the gear train 40.

Figure 18:
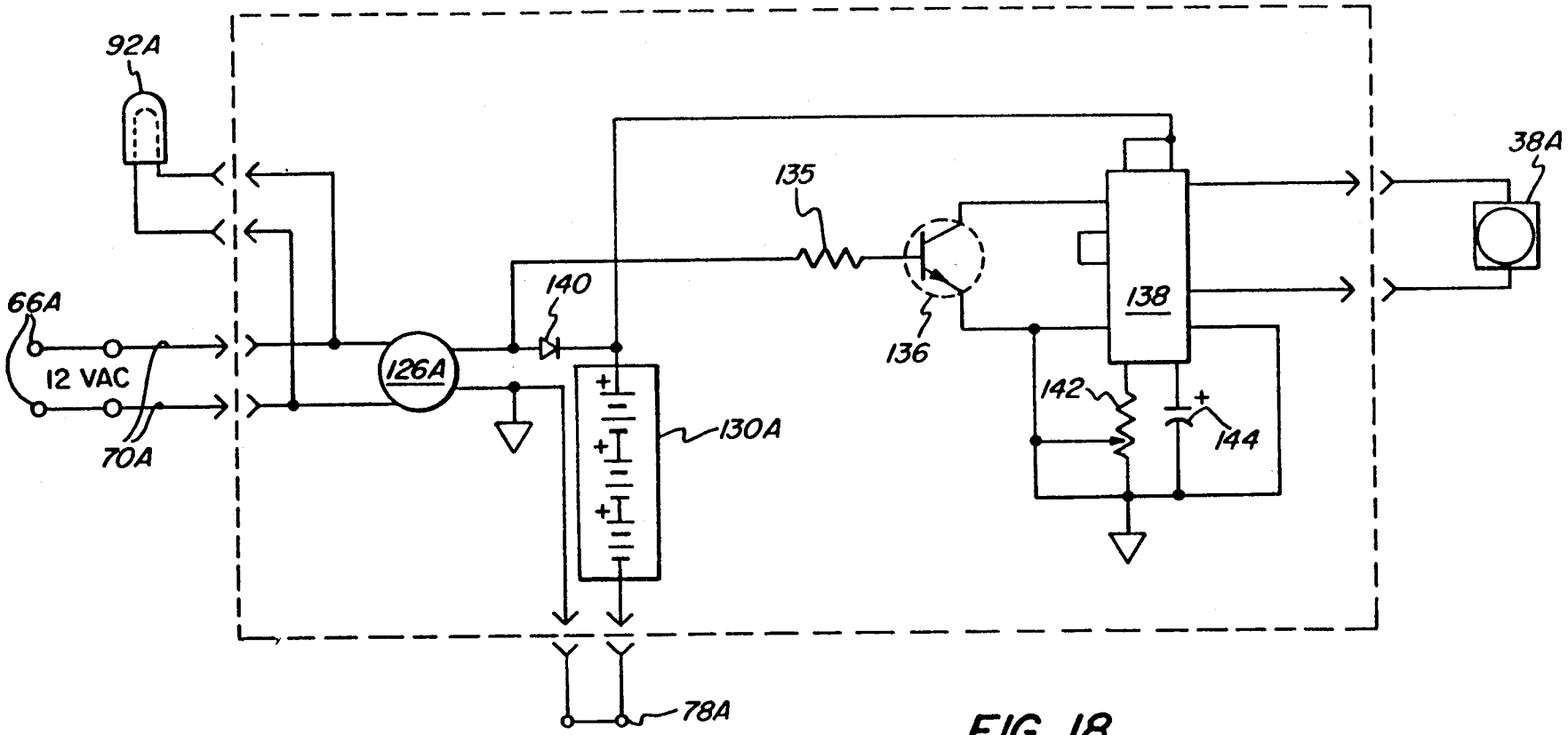
FIG. 18 is a circuit diagram of an alternative control circuit for the lighting fixture.

Another embodiment of the control circuit is shown in FIG. 18. This circuit uses a current sensing technique to yield the desired movement of the interior housing 30. To activate the low voltage lighting fixture 10, twelve volt alternating current electrical power is applied to the input electrical line 66A whereby the lamp 92A is powered and a rectifier 126A supplies the direct current voltage through a resistor 135 to a switching transistor 136 and motor driver chip 138. A charging current is also supplied through protection diode 140 to a rechargeable battery pack 130A.

The motor driver chip 138 applies power to the motor 38A driving the interior housing 30 in an upward direction until it comes to its fully protracted position. Once the fully protracted position is reached, the motor 38A draws more current until the motor driver chip 138 shuts off the output power. This maximum current level is set by variable resistance 142 for a delay time set by a capacitor 144.

To deactivate the low voltage lighting fixture 10, the twelve-volt alternating current electrical power is removed so the switching transistor 136 shuts off, sending a signal to the motor driver chip 138 to activate the motor 38A to send the interior housing 30 in the downward direction. This movement is powered by the battery pack 130A. Once the lower stop is reached, the motor driver chip 138 shuts off the output power which stops the motor 38A. The battery switch 78A is activated, removing current drawn from the batteries 130A by the motor driver chip 138.

Referring now to FIGS. 19 through 22 therein is illustrated a second embodiment of the low voltage lighting fixture generally designated by the numeral 210 and made according to the present invention. The low voltage lighting fixture 210 has a hollow elongated tubular exterior housing 212 having a disk-shaped end cap 216 at its lower end and an annular shaped cover member 218 at its upper end. The annular shaped cover member 218 can have a leveling device in the form of a bubble level similar to that found in the first embodiment for facilitating installation of the lighting fixture 210 in the ground. To hold the annular shaped cover member 218 to the exterior housing 212, four self tapping screw fasteners 228 (only two shown in FIG. 19) extend through the annular shaped cover member 218 and into the exterior housing 212. The fasteners 228 also secure a resilient wiper gasket 264. Desirably, the end cap 216 has drain holes (not shown) to permit the egress of water.

Figure 19:
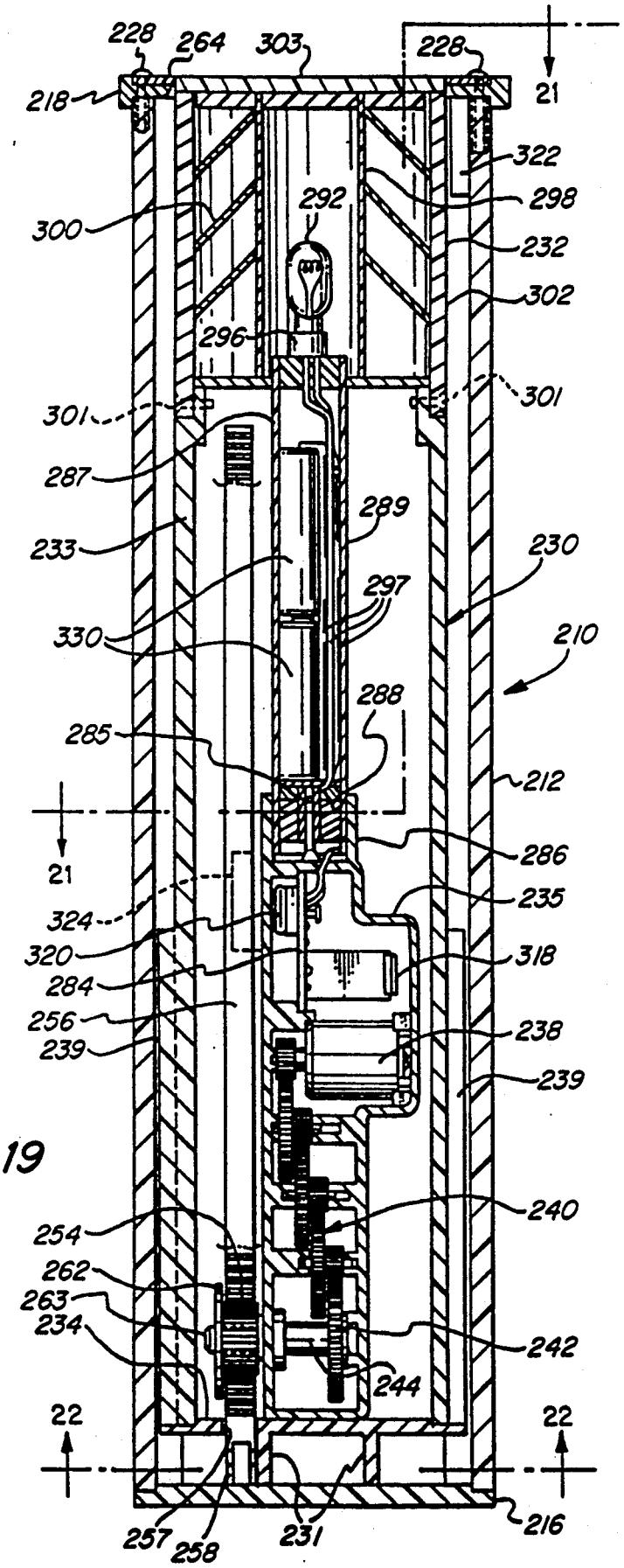
FIG. 19 is a longitudinal cross-sectional view of the second embodiment of the low voltage lighting fixture of the present invention.
Figure 20:
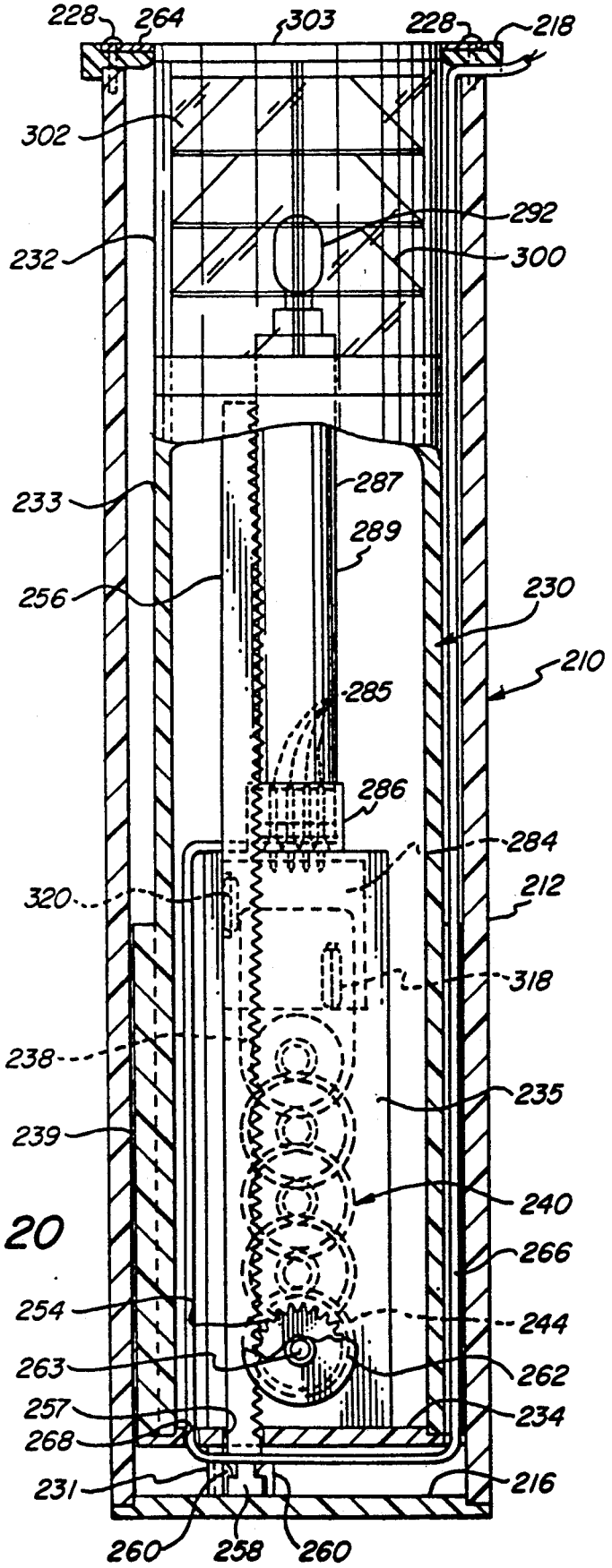
FIG. 20 is a side elevational view of the low voltage lighting fixture of FIG. 19 with portions broken away to show internal structure.
Figure 21:
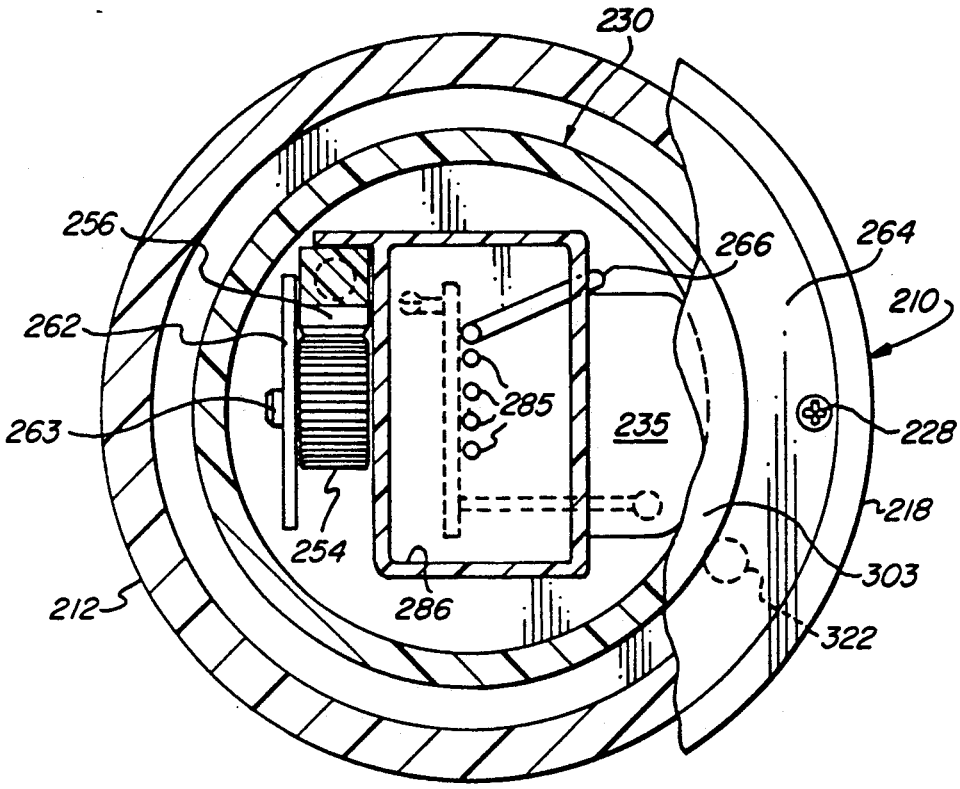
FIG. 21 is a cross-sectional view taken along the 21—21 line of FIG. 19 with the battery pack removed to illustrate the socket therefor.

The low voltage lighting fixture 210 also includes a tubular interior lamp housing generally indicated by the numeral 230 retractable into the elongated exterior housing 212 into a position abutting stop ribs 231 (FIGS. 19 and 22) extending upwardly from the end cap 216 on the bottom of the exterior housing 212. In FIGS. 19 and 20, the interior housing 230 is shown in its retracted or deactuated position and includes an upper lamp portion indicated by the numeral 232 and a lower housing portion indicated by the numeral 233. The lower housing portion 233 includes an end cap 234 and contains an electrical housing portion 235 which is watertight to protect the electrical and mechanical components contained therein as will be described further hereinafter.

Figure 22:
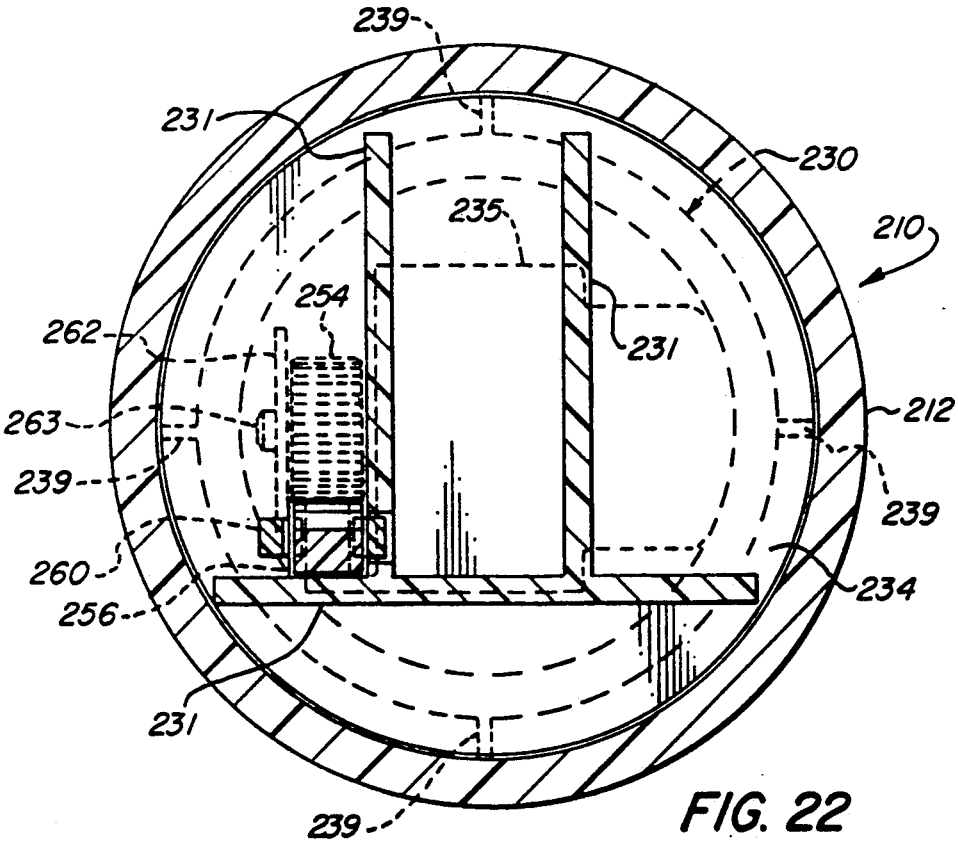
FIG. 22 is a cross-sectional view taken along the 22—22 line of FIG. 19.

As seen in FIGS. 19, 20 and 22, the exterior of the lower housing portion 233 has four integrally molded spaced apart guide ribs 239 in sliding contact with the cylindrical interior of the elongated exterior housing 212 to stabilize the interior housing 230 during retraction and protraction thereof. To accomplish the desired protraction and retraction movements of the interior housing 230, a motorized drive mechanism is provided in the electrical housing portion 235 of the interior housing 230 as best seen in FIGS. 19 and 20.

The motorized drive mechanism has a low voltage high speed direct current motor 238 rated at approximately six thousand rpm. To achieve the high torque needed to move the interior housing 230 between its retracted and protracted positions, a speed reduction mechanism in the form of a gear train generally indicated by the numeral 240 is provided in a well-known manner by three identical reducing or cluster gears. A final gear 242 in the gear train 240 is rotatably mounted on a drive shaft 244 journalled for rotation in the electrical housing portion 235 of the interior housing 230. The drive shaft 244 extends through the wall of the electrical housing portion 235 in a watertight manner. Fixedly mounted on the protruding end of the drive shaft 244 is a pinion gear 254 sized for driving engagement with a gear rack 256 secured to the end cap 216 on the elongated exterior housing 212 and extending through an opening 257 in the end cap 234 into the interior of the interior housing 230. A lower tab portion 258 of the rack 256 is captured between two resilient fingers 260 on the end cap 216 whereby the rack 256 is securely but removably held in the elongated exterior housing 212. A guide flange 262 is secured to the end of the drive shaft 244 by a screw fastener 263 to act as a guide for the pinion gear 254 along the rack 256.

Turning again to FIG. 20, a twelve-volt alternating current (12 VAC) electrical line 266 extends through the elongated exterior housing 212 under the cover member 218 and then down the inner surface of the exterior housing 212. The electrical line 266 runs along the end cap 234 and enters the interior housing 230 through an aperture 268. The electrical line 266 then extends to the top of the electrical housing portion 235 where it enters the same in a watertight manner. There the electrical line 266 connects to a printed circuit board 284, the configuration and operation of which will be explained further hereinafter. Four electrical pins 285 extend from the printed circuit board 284 into a socket 286 located at the top of the electrical housing portion 235. Mounted in the socket 286 and electrically connected to the pins 285 is a battery pack 287 which comprises a female electrical connector 288, a housing 289, two nickel-cadmium rechargeable 1.2 volt batteries 330, lamp socket 296 and lamp 292. The female electrical connector 288 is sized to receive the pins 285 and is electrically connected to the batteries 330 and the lamp socket by wires 297. The housing 289 can be made in two pieces to facilitate insertion of the batteries 330 and the other components therein.

Surrounding the lamp 292 is the upper lamp portion 232 which includes an inner diffuser lens 298, a light baffle 300 and a transparent outer lens 302. The outer lens 302 seats on the lower housing portion 233 and is held in place by screw fasteners 301 which threadingly engage the lower housing portion 233. The upper end of the outer lens 302 is provided with an interior housing cover 303. As in the first embodiment, the inner diffuser lens 298, the baffle 300 and the outer lens 302 can be interchangeable with a variety of different type assemblies such as those shown in FIGS. 9 through 16 or an assembly especially designed by or for the user to meet a specific lighting need or requirement.

Referring again to FIGS. 19 and 20, mounted inside the electrical housing portion 235 on the printed circuit board 284 are upper and lower single pull, double throw magnetic proximity reed switches 318 and 320. These switches 318 and 320 are positioned to be actuated by upper and lower magnetic actuators 322 and 324, respectively, located on the inside of the elongated exterior housing 212 and on the rack 256 to control the movement of the interior housing 230 as will be explained forthwith.

Figure 23:
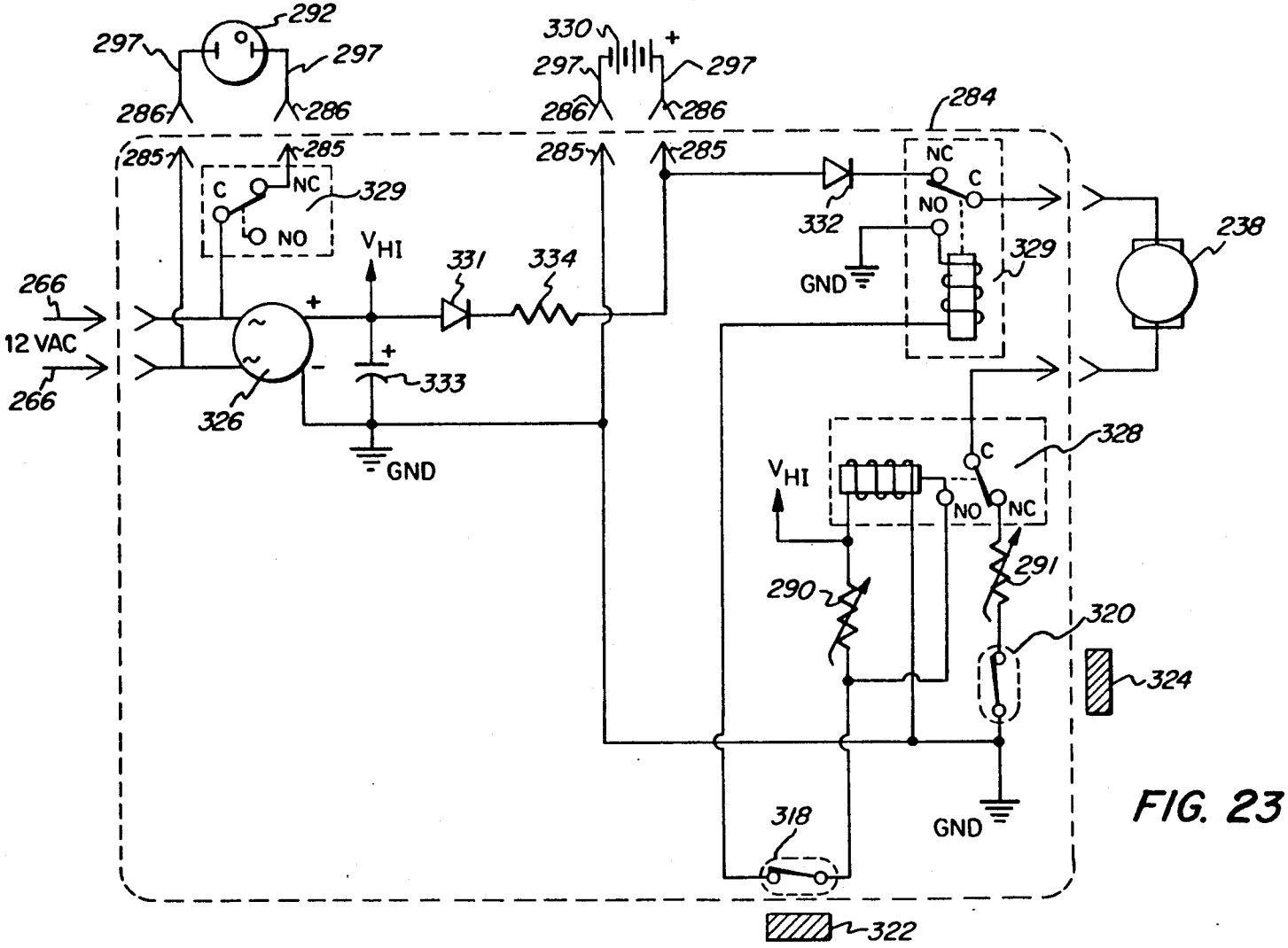
FIG. 23 is a circuit diagram of the control circuit for the second embodiment of the low voltage lighting fixture.

Turning now to FIG. 23, therein illustrated is a circuit used to control the up and down movement of the interior housing 230. The circuit includes the printed circuit board 284 which has a pair of resettable circuit breakers 290, 291, bridge rectifier 326 (100 V, 1.4 A), a one pole-double throw relay 328, a two pole-double throw relay 329, diodes 331, 332, a capacitor 333 and a current limiting resistor 334.

The circuit operates in the following manner. In the normal unpowered state of the lighting fixture 210, the interior housing 230 is fully retracted into the elongated exterior housing 212 as shown in FIGS. 19 and 20. To activate the low voltage lighting fixture 210, twelve-volt alternating current electrical power can be applied to the input electrical cable 266 through use of a timing switch or low light sensor (not shown). The bridge rectifier 326 then supplies direct current voltage to the coils of the relays 328, 329 and a charging current to the batteries 330 through capacitor 333, diode 331 and resistor 334. Relay 328, 329 are then activated switching power to the motor 238 driving the interior housing 230 in an upward direction through mechanical cooperation of the gear train 240, drive shaft 244, pinion gear 254 and rack 256. The electrical line 266 hangs under the interior housing 230 as it ascends.

The interior housing 230 stops its movement in the upward direction as power is cut off to the motor 238 and applied to the lamp 292 when the upper proximity switch 318 is opened by the upper magnetic actuator 322 in the elongated exterior housing 212 which then removes power to the coil of relay 329 thereby removing the ground path for motor 23 and simultaneously applying power to lamp 292 via the second pole of relay 329. The rechargeable batteries 330 are charged by the current through diode 331 and limiting resistor 334 as long as the electrical power is supplied through the electrical line 266 and the battery pack 287 remains plugged into socket 286.

To deactivate the low voltage lighting fixture 210, the twelve-volt alternative current electrical power is removed from the input electrical cable 266 through use of the timing switch or low light sensor (not shown) whereby the relay 328 and lamp 292 are deactivated. In turn, the relays 328, 329 switch power to the motor 238 via the batteries 330. The motor 238 drives the interior housing 230 in the downward direction through cooperation of the gear train 240, drive shaft 244, pinion gear 254 and rack 256 until the lower proximity switch 320 opens when actuated by the magnetic actuator 324 as the interior housing 230 returns to its retracted position.

If an outside influence, such as a vandal or other obstruction, were to push down on the interior housing 230 when it is in its protracted position, the interior housing 230 will be allowed to retract under the force of the outside influence as the drive shaft 244 and pinion gear 254 rotate with the gear train 240 without damage to the low voltage lighting fixture 210. Once the outside influence is removed, the motor 238 will return the interior housing 230 to its protracted position. If the outside influence is not removed, the resettable circuit breaker 290 acting as a safety device will shut off the motor 238 and turn on the light. If an outside influence interferes with the movement of the interior housing 230 as it moves between its retracted and protracted positions for a sufficient period of time, either circuit breaker 290 or 291 will disconnect the power to the motor 238 to prevent damage to the lighting fixture.

Figure 24:
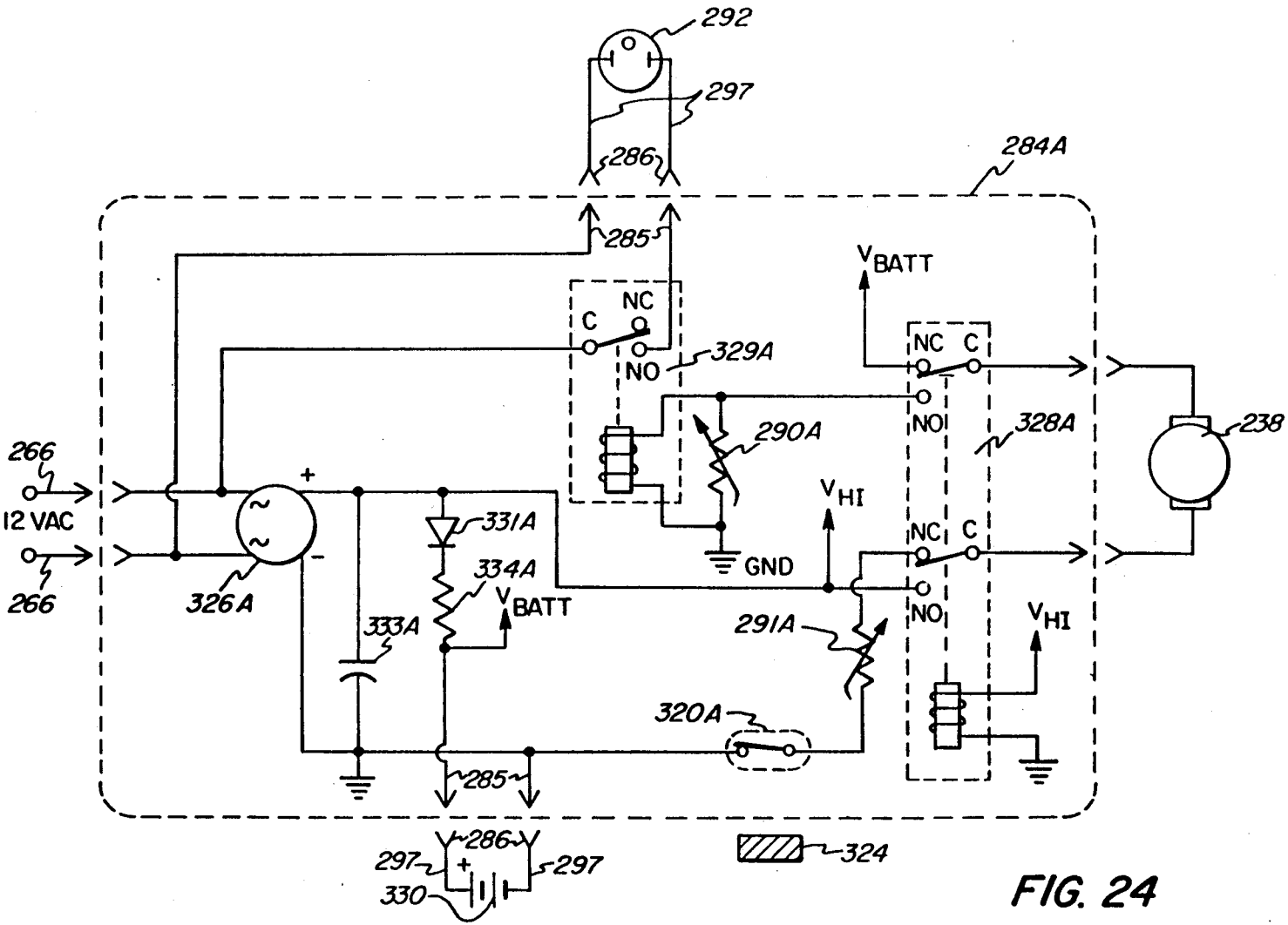
FIG. 24 is a circuit diagram of an alternative control circuit for the second embodiment of the lighting fixture.

Another embodiment of the control circuit is shown in FIG. 24. The circuit includes the printed circuit board 284A which has a pair of resettable current limiting fuses 290A, 291A, bridge rectifier 326A (100 V, 1.4 A), a two pole-double throw relay 328A, a single pole-double throw relay 329A, a diode 331A, a capacitor 333A and a current limiting resistor 334A.

The circuit operates in the following manner. In the normal unpowered state of the lighting fixture 210, the interior housing 230 is fully retracted into the elongated exterior housing 212 as shown in FIGS. 19 and 20. To activate the low voltage lighting fixture 210, twelve-volt alternating current electrical power can be applied to the input electrical cable 266 through use of a timing switch or low light sensor (not shown). The bridge rectifier 326A then supplies direct current voltage to the coil of the relay 328A and a charging current to the batteries 330A through capacitor 333A, diode 331A and resistor 334A. The relay 328A is then activated switching power to the motor 238 driving the interior housing 230 in an upward direction through mechanical cooperation of the gear train 240, drive shaft 244, pinion gear 254 and rack 256.

The interior housing 230 stops its movement in the upward direction as power is cut off to the motor 238 and applied to the lamp 292 when the interior housing 230 reaches the end of its protraction stroke thereby activating the resettable current limiting fuse 290A. Activation of the fuse 290A energizes the coil of the relay 329A thereby illuminating the lamp 292. The rechargeable batteries 330 are charged by the current through diode 332A and limiting resistor 334A as long as the electrical power is supplied through the electrical line 266 and the battery pack 287 remains plugged into socket 286.

To deactivate the low voltage lighting fixture 210, the twelve-volt alternative current electrical power is removed from the input electrical cable 266 through use of the timing switch or low light sensor (not shown) whereby the relays 328A, 329A and lamp 292 are deactivated. In turn, the relay 328A switches power to the motor 238 via the batteries 330. The motor 238 drives the interior housing 230 in the downward direction through cooperation of the gear train 240, drive shaft 244, pinion gear 254 and rack 256 until the lower proximity switch 320A opens when actuated by the magnetic actuator 324 as the interior housing 230 returns to its retracted position.

If an outside influence, such as a vandal or other obstruction, were to push down on the interior housing 230 when it is in its protracted position, the interior housing 230 will be allowed to retract under the force of the outside influence as the drive shaft 244 and pinion gear 254 rotate with the gear train 240 without damage to the low voltage lighting fixture 210. Once the outside influence is removed, the motor 238 will return the interior housing 230 to its protracted position. If the outside influence is not removed, the resettable current limiting fuse 290A acting as a safety device will shut off the motor 238 and turn on the light. If an outside influence interferes with the movement of the interior housing 230 as it moves between its retracted and protracted positions for a sufficient period of time, either fuse 290A or 291A will disconnect the power to the motor 238 to prevent damage to the lighting fixture.

In the event the low voltage lighting fixture 210 needs servicing, this can be easily accomplished by first applying power to the electrical line 266 to drive the interior housing 230 to its protracted position. By loosening the screws 301, the upper lamp portion 232 can be removed to gain access to the battery pack 287. Removal of the battery pack 287 from the socket 286 prevents the motor 238 from being driven in the downward direction. By removing the cover member 218, the interior housing 230 can be pulled out of the elongated exterior housing 212 for servicing the light fixture 210.

In operation, in both embodiments of the low voltage lighting fixture of the present invention, the fixture can buried in the ground so that the annular shaped cover member is flush with the ground. The leveling device is used to ensure the lighting fixture is level. The lighting fixture is connected to a low voltage electrical source through its electrical line. The lighting fixture can then perform its lighting function as heretofore described.

Most of the structural components of the lighting fixtures of the present invention such as the exterior and interior housings are molded from a plastic resin such as high density polyethylene but it should be apparent to those skilled in the art that they may be manufactured from other suitable materials which exhibit weather resistant qualities. The lighting fixtures of the present invention can be made in a variety of sizes.

Thus, it can be seen from the foregoing specification and the attached drawings that the low voltage lighting fixture of the present invention provides an effective means for flush mounting the fixture unobtrusively in the ground, yet has an interior housing which protracts from the ground when the lighting fixture is activated.

The preferred embodiments described above admirably achieve the objects of the invention; however, it will be appreciated that departure can be made by those skilled in the art without departing from the spirit and scope of the invention which is limited only by the following claims.

Having thus described the invention, what is claimed is:

1. A lighting fixture comprising:

A. an elongated exterior housing having an opening at one end thereof;

B. an interior housing mounted for reciprocation between a retracted position within said elongated housing and a protracted position through said opening and at least partially extended from said elongated housing, said interior housing having an upper lamp portion and a lower motor portion;

C. motorized drive means in said lower motor portion for operationally engaging said exterior housing for moving said interior housing between said retracted and protracted positions;

D. a lamp in said upper lamp portion of said interior housing to provide illumination;

E. primary electrical power means operatively connected to said lamp and said motorized drive means whereby activation of said primary electrical power means causes said motorized drive means to move said interior housing from its retracted position to its protracted position and illuminates said lamp; and F. auxiliary electrical power means within said interior housing and operatively connected to said motorized drive means to move said interior housing from its protracted position to its retracted position.

2. The lighting fixture in accordance with claim 1 wherein said auxiliary electrical power means energizes said motorized drive means to move said interior housing from its protracted position to its retracted position when said primary electrical power means is deactivated.

3. The lighting fixture in accordance with claim 2 wherein said auxiliary electrical power means includes a rechargeable battery pack connected to said primary power means and rechargeable when said interior housing is in its protracted position.

4. The lighting fixture in accordance with claim 3 wherein said lamp is carried on said battery pack and connected to said primary power means.

5. The lighting fixture in accordance with claim 4 wherein said battery pack includes a battery pack housing, at least one battery in said battery pack housing, a connector for said lamp on one end thereof and a connector for connection to said motorized drive means and said primary electrical power means on the other end thereof.

6. The lighting fixture in accordance with claim 1 wherein said auxiliary electrical power means includes a rechargeable battery pack operatively connected to said primary power means and rechargeable when said interior housing is in its protracted position.

7. The lighting fixture in accordance with claim 6 wherein said lamp is carried on said battery pack and connected to said primary power means.

8. The lighting fixture in accordance with claim 7 wherein said battery pack includes a battery pack housing, at least one battery in said battery pack housing, a connector for said lamp on one end thereof and a connector for connection to said motorized drive means and said primary electrical power means on the other end thereof.

9. The lighting fixture in accordance with claim 1 wherein said auxiliary electrical power means includes a removable battery pack which is adapted to be disconnected from said motorized drive means and removed from said interior housing.

10. The lighting fixture in accordance with claim 9 wherein said lamp is carried on said battery pack and connected to said primary power means.

11. The lighting fixture in accordance with claim 10 wherein said battery pack includes a battery pack housing, at least one battery in said battery pack housing, a connector for said lamp on one end thereof and a connector for connection to said motorized drive means and said primary electrical power means on the other end thereof.

12. The lighting fixture in accordance with claim 9 wherein said upper lamp portion of said interior housing is removable to provide access to said battery pack for removing the same.

13. The lighting fixture in accordance with claim 1 wherein said motorized drive means is provided with a safety interlock means for deactivating said motorized drive means in the event said interior housing is obstructed from moving between its retracted and protracted positions.

14. The lighting fixture in accordance with claim 13 wherein said safety interlock means includes a circuit breaker to deenergize said motorized drive means in the event movement of said interior housing is obstructed.

15. The lighting fixture in accordance with claim 13 wherein said safety interlock means is a current sensing circuit to deactivate said motorized drive means in response to a predetermined current draw for a prescribed period of time.

16. The lighting fixture in accordance with claim 1 wherein said motorized drive means includes limit switch means to deactivate said motorized drive means in said retracted and protracted positions.

17. The lighting fixture in accordance with claim 16 wherein said limit switch means is at least one magnetically actuated proximity switch mounted on said interior housing.

18. The lighting fixture in accordance with claim 17 where said at least one magnetically actuated proximity switch is actuated by a magnet when said interior housing reaches said retracted and protracted positions.

19. The lighting fixture in accordance with claim 1 wherein said motorized drive means includes a high speed drive motor and a gear reduction system to yield a high torque output from said high-speed motor thereby providing a substantial driving force to said interior housing.

20. The lighting fixture in accordance with claim 19 wherein said gear reduction system has a final drive shaft drivingly engaging said exterior housing.

21. The lighting fixture in accordance with claim 1 wherein said exterior housing has a cover mounted on the end thereof forming said opening.

22. The lighting fixture in accordance with claim 1 wherein said upper lamp portion of said interior housing is removable to provide access for servicing said lamp mounted therein.

23. The lighting fixture in accordance with claim 22 wherein said interior housing further includes lens means mounted within said upper lamp portion of said interior housing.

24. The lighting fixture in accordance with claim 23 wherein said lens means is a diffuser lens and a light baffle to appropriately direct light from said lamp.

25. The lighting fixture in accordance with claim 1 wherein said interior housing further includes lens means mounted within said upper lamp portion of said interior housing.

26. The lighting fixture in accordance with claim 25 wherein said lens means is a diffuser lens and a light baffle to appropriately direct light from said lamp.

27. A lighting fixture comprising:

A. an elongated exterior housing having an opening at one end thereof;

B. an interior housing mounted for reciprocation between a retracted position within said elongated housing and a protracted position through said opening and at least partially extended from said elongated housing, said interior housing having an upper lamp portion and a lower motor portion;

C. motorized drive means in said lower motor portion for operationally engaging said exterior housing for moving said interior housing between said retracted and protracted positions;

D. a lamp in said upper lamp portion of said interior housing to provide illumination;

E. electrical power means operatively connected to both said lamp to provide illumination thereto and to said motorized drive means to move said interior housing between its retracted position and its protracted position; and F. circuit means for disconnecting said motorized drive means from said electrical power means in the event said interior housing is obstructed from moving between its retracted and protracted positions.

28. The lighting fixture in accordance with claim 27 wherein said circuit means includes a circuit breaker to deenergize said motorized drive means in the event movement of said interior housing is obstructed.

29. The lighting fixture in accordance with claim 27 wherein said circuit means also deenergizes said motorized drive means when said interior housing reaches its retracted and protracted positions.

30. The lighting fixture in accordance with claim 27 wherein said motorized drive means includes limit switch means to deactivate said motorized drive means in said retracted and protracted positions.

31. The lighting fixture in accordance with claim 30 wherein said limit switch means is at least one magnetically actuated proximity switch mounted on said interior housing.

32. The lighting fixture in accordance with claim 31 where said at least one magnetically actuated proximity switch is actuated by a magnet when said interior housing reaches said retracted and protracted positions.

33. The lighting fixture in accordance with claim 27 wherein said lamp is illuminated when said interior housing is in its protracted position and when said circuit means is actuated.

34. The lighting fixture in accordance with claim 27 wherein said circuit means resets itself when said interior housing is no longer obstructed.

35. A lighting fixture comprising:

A. an elongated exterior housing having an opening at one end thereof;

B. an interior housing mounted for reciprocation between a retracted position within said elongated housing and a protracted position through said opening and at least partially extended from said elongated housing, said interior housing having an upper lamp portion and a lower motor portion;

C. motorized drive means in said lower motor portion for operationally engaging said exterior housing for moving said interior housing between said retracted and protracted positions;

D. a lamp in said upper lamp portion of said interior housing to provide illumination;

E. electrical power means operatively connected to both said lamp to provide illumination thereto and to said motorized drive means to move said interior housing between its retracted position and its protracted position; and F. said upper lamp portion being removable from said lower motor portion thereby permitting access to said lamp for servicing the same and permitting replacement of said lamp portion with a different style thereof.

36. A rechargeable battery pack for use in a lighting fixture comprising an elongated exterior housing having an opening at one end thereof, an interior housing mounted for reciprocation from a retracted position within said elongated housing to a protracted position through said opening and at least partially extended from said elongated housing, said interior housing having an upper lamp portion and a lower motor portion, motorized drive means in said lower motor portion for operationally engaging said exterior housing for moving said interior housing between said retracted and protracted positions, a lamp in said upper lamp portion of said interior housing to provide illumination, and primary electrical power means operatively connected to both said lamp to provide illumination thereto and to said motorized drive means to move said interior housing from its retracted position to its protracted position, said rechargeable battery pack providing auxiliary electrical power to energize said motorized drive means to move said interior housing from its protracted position to its retracted position when said primary electrical power means is deactivated, said rechargeable battery pack comprising:

a battery pack housing, at least one battery in said battery pack housing, a connector for said lamp on one end thereof and a connector for connection to said motorized drive means and said primary electrical power means on the other end thereof.

37. The battery pack in accordance with claim 36 wherein said rechargeable battery pack is adapted to be connected to said primary power means and is rechargeable when said interior housing is in its protracted position.

38. The battery pack in accordance with claim 37 wherein said lamp is carried on said connector therefor and is connected to said primary power means.

39. The battery pack in accordance with claim 36 wherein said upper lamp portion of said interior housing is removable to provide access for removing said battery pack therefrom.

* * * * *